US006551079B1

(12) United States Patent
Iwata et al.

(10) Patent No.: US 6,551,079 B1
(45) Date of Patent: Apr. 22, 2003

(54) INK-JET RECORDING APPARATUS AND PARTS THEREOF

(75) Inventors: Masakatsu Iwata, Kawasaki (JP); Masanori Kaneko, Kawasaki (JP); Hisashi Taniguchi, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 09/594,522

(22) Filed: Jun. 16, 2000

(30) Foreign Application Priority Data

Jun. 24, 1999 (JP) ..... 11-178407
Jul. 1, 1999 (JP) ..... 11-187766

(51) Int. Cl.[7] ..... F04B 39/10

(52) U.S. Cl. ..... 417/440; 417/545; 137/625.47; 251/309; 251/368; 347/85

(58) Field of Search ..... 417/440, 545; 137/625.47; 251/309, 368; 347/85

(56) References Cited

U.S. PATENT DOCUMENTS 2,490,553 A * 12/1949 Smith ..... 174/52.1
3,059,586 A * 10/1962 Brailsford ..... 222/67
5,722,458 A * 3/1998 Potter ..... 137/240
6,082,979 A * 7/2000 Friedman ..... 4/431

* cited by examiner

*Primary Examiner*—Charles G. Freay
(74) *Attorney, Agent, or Firm*—Fitzpatrick, Cella, Harper & Scinto

(57) ABSTRACT

When a piston unit and a valve unit employed in a recording head of an ink-jet recording apparatus were manufactured by a conventional method, comprising parts for these unit were separately formed and assembled, which required considerable man-hours for the assembly and measures to prevent contamination by foreign particles during the assembly. The present invention is carried out to solve these problems and provides units at less expensive cost. In order to attain above-mentioned objectives the units are formed out of mutually insoluble materials with other parts by an insert molding or a multi-color molding. By employing forming materials with different molding shrinkage rate, desired gas-tightness of the units are attained by keeping moving performances of the units almost intact. In addition a rubber or an elastomer is employed as a material for a part which requires a gas-tightness and flexibility.

40 Claims, 16 Drawing Sheets

INK-JET RECORDING APPARATUS AND PARTS THEREOF

BACKGROUND OF THE INVENTION

1. Field of Invention

The present invention relates peripheral parts such as a piston, a check valve and a rotary valve for a liquid reservoir in an ink-jet recording system and manufacturing methods of them and also relates an ink-jet recording apparatus having such parts.

2. Brief Description of the Related Arts

FIG. 22 shows a sectional view of an example of conventional piston pumps for liquid ink, consisted of three parts, a cylinder 1, a piston 2 and a check valve 3, assembled into a finished product by inserting the piston 2 into the cylinder 1 after the check valve 3 is engaged in the piston as shown by an arrow in FIG. 23. Character 1*a* stands for a suction channel for ink, 1*b* stands for a cylinder space at an ejecting side, 2*a* stands for an ink channel, 2*b* stands for a rod portion of the piston, 3*a* stands for a valve plate and 3*b* stands for anchor boss respectively.

However, in the manufacturing method of the above-mentioned piston pump an assembling procedure of three parts is inevitable, which requires cost increase in addition to a time for assembling.

Moreover, measures to prevent foreign particles from getting into the piston 2 and the check valve 3 are required so as to keep a good sealing performance of the finished product. Similarly a care to prevent foreign particles from getting into the cylinder 1 is necessary before assembling the cylinder 1 and the piston 2.

In manufacturing rotary valves or slide valves to open/shut or to alter liquid paths, the same manufacturing procedure as the piston pump is employed, where an inner cylinder as a first part, an outer cylinder as a second part and a fastener to prevent the inner cylinder from slipping-out of the outer cylinder, are assembled after forming three parts separately.

This manufacturing procedure, however, also has a drawback requiring an additional assembling step after each part is formed separately, and as a result cost increase as in the case of the previous example.

Some of the finished products consisted of the above-mentioned two parts do not acquire stable rotations or slides due to discrepancies in dimensions or shapes caused by separately manufacturing procedures of the two parts. In some cases liquid leaks out from the finished unit.

In this conventional method, since the additional fastener to prevent the inner cylinder from slipping-out of the outer cylinder is required, number of parts is increased and as a result additional assembling cost is inevitable.

SUMMARY OF THE INVENTION

The present invention is carried out in view of the above-mentioned problems and the first objective of the present invention is to supply peripheral parts for ink reservoirs employable for ink-jet recording apparatuses.

The second objective of the present invention is to supply inexpensive parts with less dispersion in their dimension and shape by eliminating assembling procedure of parts followed by forming the above-mentioned parts separately.

The third objective of the present invention is to supply gas-tight and inexpensive parts by employing an elastic material for at least one of the parts.

The present invention is carried out to provide a piston pump, a valve, a pump unit for an ink-jet recording apparatus or an ink-jet recording apparatus according to any one of the following which attain the above-mentioned objectives.

(1) A piston pump comprised of a cylinder, a piston and a valve formed out of mutually insoluble materials each other by an insert molding or a multi-color molding.

(2) A valve comprised of a first part having a cylindrical hole bearing at least one opening for flow path and a second part engaged in the cylindrical hole of the first part capable of rotating freely so as to connect with at least one of the openings for the flow path of the first part, and the first and second parts are formed out of mutually insoluble materials by an insert molding or a two color molding.

(3) A valve comprised of a first part having a cylindrical hole bearing at least two openings for flow paths and a second part, engaged in the cylindrical hole of the first part capable of rotating freely so as to select at least one of the openings for the flow paths of the first part selectively and the first and second parts are formed out of mutually insoluble materials by an insert molding or a two color molding.

(4) A valve comprised of a first part having a cylindrical hole bearing at least one opening for flow path and a second part engaged in the hole of the first part capable of sliding freely so as to connect with at least one of the openings for the flow path of the first part and the first and second parts are formed out of mutually insoluble materials by an insert molding or a two color molding.

(5) A valve comprised of a first part having a cylindrical hole bearing at least two openings for flow paths and a second part engaged in the hole of the first part capable of sliding freely so as to select at least one of the openings for the flow paths of the first part selectively and the first and second parts are formed out of mutually insoluble materials by an insert molding or a two color molding.

(6) Parts for an ink-jet recording apparatus wherein parts are contacted with ink and with other parts, and the parts are formed out of mutually insoluble materials each other by an insert molding or a multi-color molding.

The above-mentioned constitutions according to the present invention, are capable of eliminating assembling procedures by employing insert molded or multi-color molded pumps or valves out of mutually insoluble materials for each other part so as to reduce supervising manhours for manufacturing and so as to provide inexpensive parts with high reliability for an ink-jet recording apparatus.

DETAILED DESCRIPTION OF THE PREFERRED EMBODIMENTS

Hereinafter detailed embodiments of the present invention are described by referring to corresponding drawings.

Embodiment 1

Figure 1:
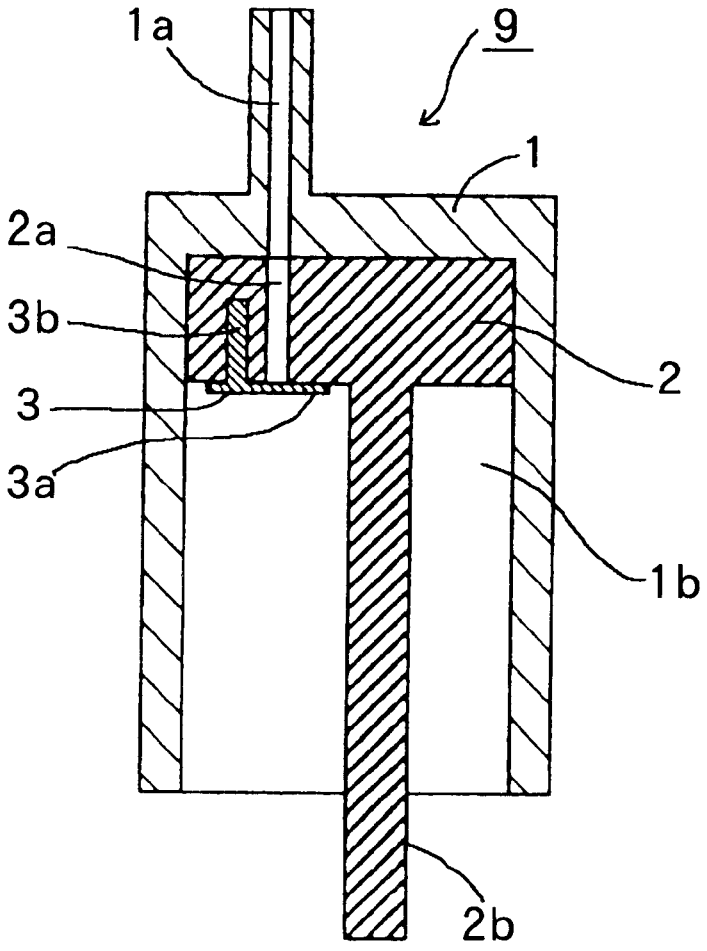
FIG. 1 is a sectional view of a pump in a first embodiment.

FIG. 1 is a sectional view of a piston pump 9 consisted of a cylinder 1, a piston 2 and a check valve 3 in the embodiment 1. The cylinder 1, the piston 2 and the check valve 3 are formed out of different resin materials mutually insoluble each other so as to obtain a finished product as shown in FIG. 1 by an insert molding or a multi-color molding (a two color molding is included). In the figure, 1*a* stands for an ink suction channel, 1*b* stands for a cylinder space at an ink ejecting side, 2*a* stands for an ink channel, 2*b* stands for a rod portion of the piston, 3*a* stands for a valve plate and 3*b* stands for an anchor boss.

Figure 2:
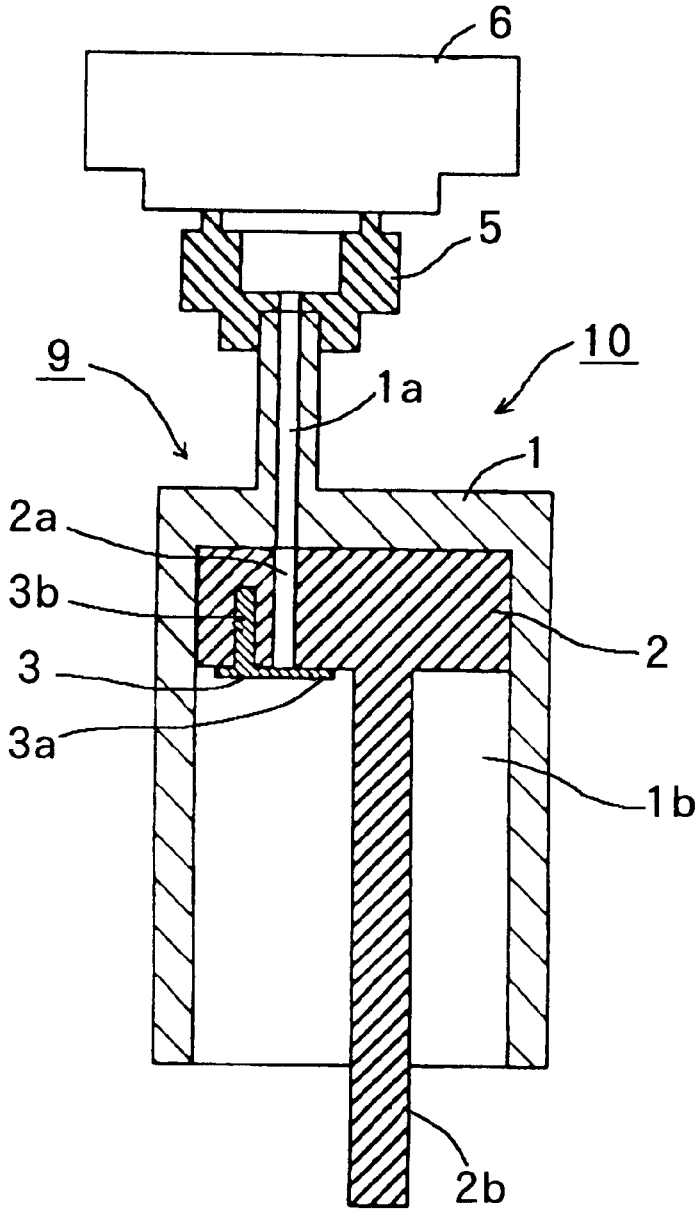
FIG. 2 is a sectional view of the pump in the first embodiment attached to an ink-jet recording head for ink suction.

FIG. 2 shows a sectional view of a pump unit 10 attached to an ink-jet recording head 6. In the figure a numeric character 5 stands for a cap.

Figure 3:
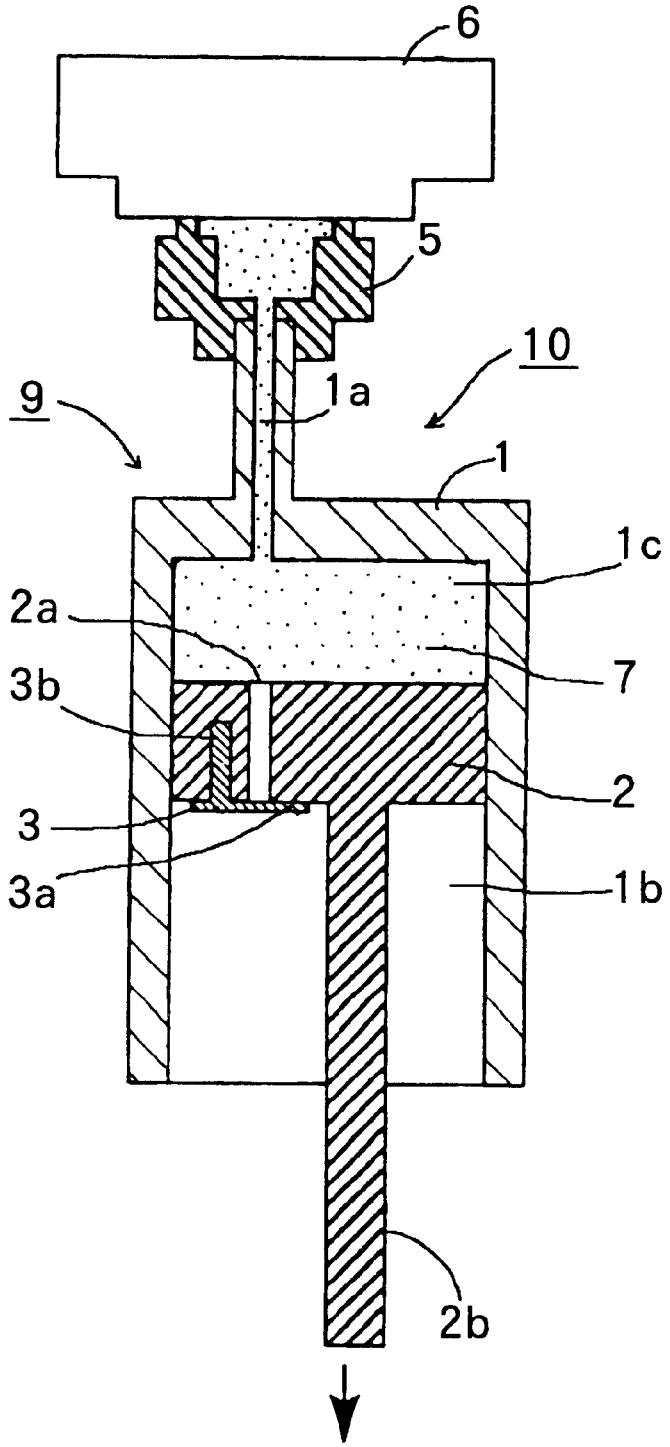
FIG. 3 is a sectional view of the pump in FIG. 2 illustrating the ink suction procedure.
Figure 4:
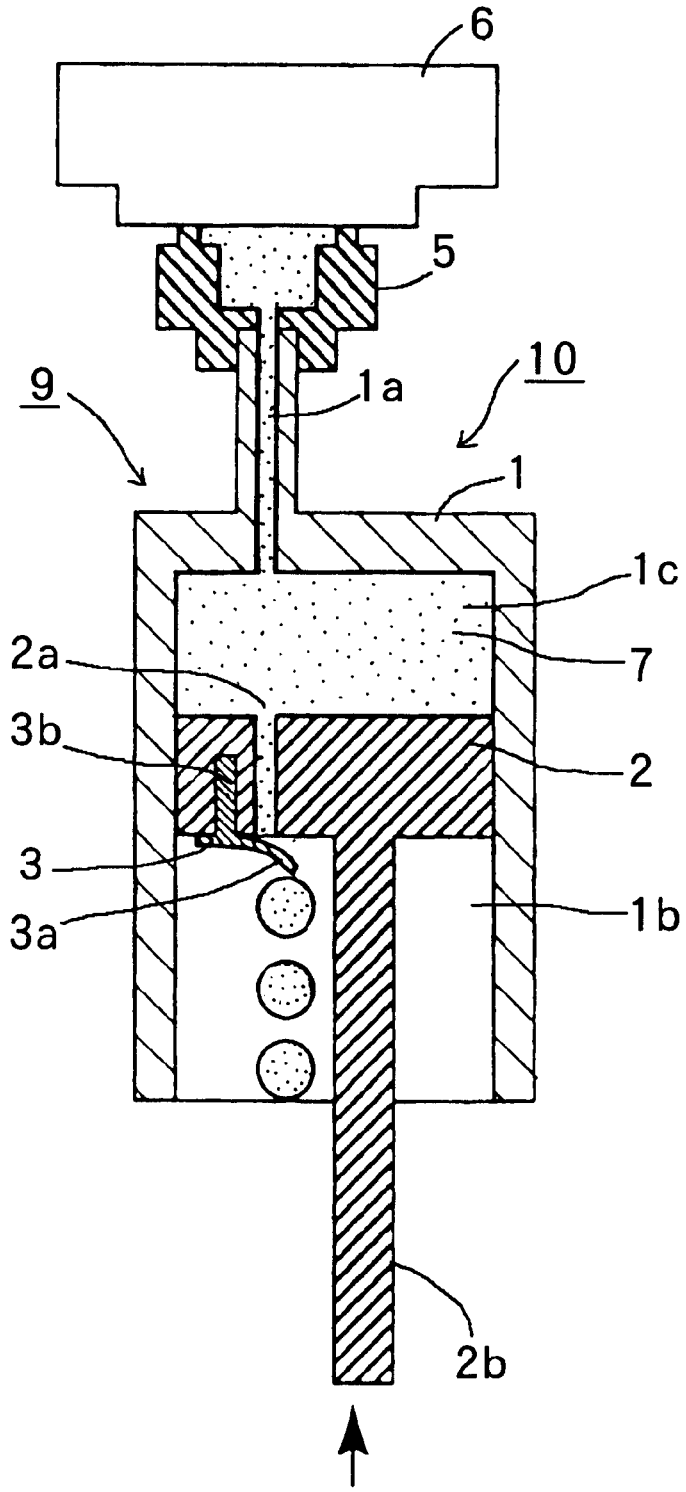
FIG. 4 is a sectional view of the pump in FIG. 3 illustrating an ink ejection procedure.

Sucking/ejecting movements of the recording head 6 are explained by referring to FIGS. 3 and 4. The sucking movement is essential to keep good recording performance by sucking foreign particles and bubbles in a nozzle of the recording head or thickened ink forcibly.

Parts manufactured by the present invention are peripheral parts of the ink-jet recording head used in a state where parts keeping contacts with ink as well as with other parts each other, and are formed out of mutually insoluble materials each other by an insert molding or a multi-color molding. "Mutually insoluble materials" means that two or more materials are not solved into other materials during the above-mentioned moldings, due to differences in melting points of these materials. Typical combinations of the insoluble materials are as follows; poly-butylene vs. styrene elastomer, ABS resin vs. PP resin, ABS resin vs. high impact resistant PS (hereinafter referred as HIPS) resin, PC resin vs. PP resin, PC resin vs. HIPS, POM resin vs. HIPS resin, and PP resin vs. HIPS resin etc.

In these figures a numeric character 6 stands for a recording head and 5 stands for a cap fitted to the recording head 6 to form a tightly closed system, usually formed out of an elastic material such as a rubber, an elastomer and so forth. In this embodiment the pump is attached to the cap 5.

FIG. 3 shows a sucking status of the pump where the piston 2 is connected with a unshown driving means via the rod portion 2*b* so as to be pulled in a direction of an arrow shown in the figure. Since a pressure in a cylinder space 1*c* at a sucking side becomes negative, ink 7 is sucked from the recording head 6 and the ink 7 flows into the cylinder space 1*c* via the suction channel 1*a* of the cylinder 1. At this stage the valve plate 3*a* of the first valve 3 is closed due to the negative pressure in the cylinder space 1*c* at the sucking side.

FIG. 4 shows an ejecting movement of ink from the cylinder space 1*c* at the sucking side to a cylinder space 1*b* at an ejecting side where the piston 2 is pushed up by the unshown driving means via the rod portion 2*b* of the piston in a direction of an arrow shown in the figure. At this stage since a pressure in the cylinder space 1*c* at the sucking side is positive, the valve plate 3*a* of the valve 3 attached to the piston 2 bends and the cylinder space 1*c* and cylinder space 1*b* are connected via the ink channel 2*a* so that ink flows from the cylinder space 1*c* to the cylinder space 1*b*.

By repeating a series of these sucking and ejecting movements, foreign particles and bubbles or stuck ink and thickened ink etc. which will cause poor recording performance, are removed.

Figure 5:
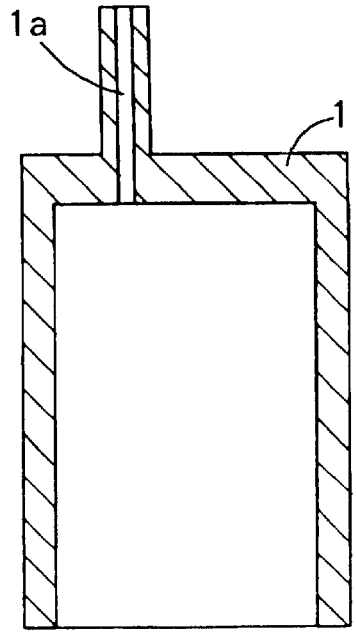
FIG. 5 is a sectional view of a first forming step of the pump in FIG. 1.
Figure 6:
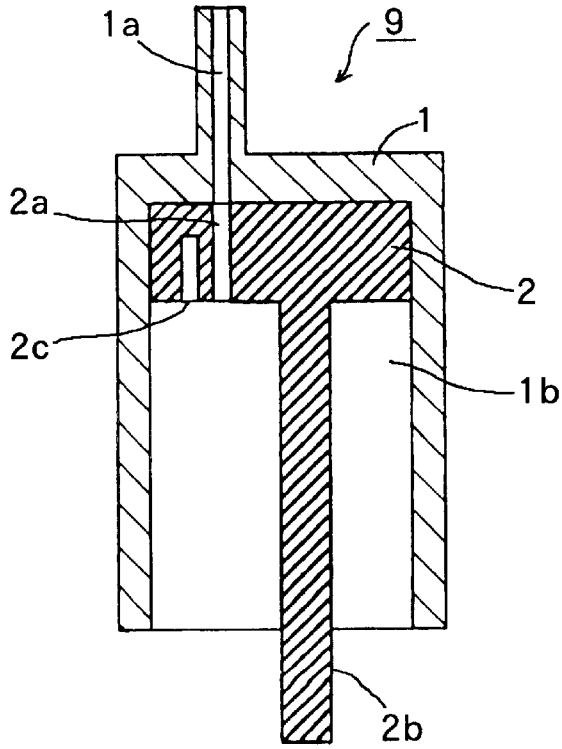
FIG. 6 is a sectional view of a second forming step of the pump in FIG. 5

FIG. 5 and FIG. 6 illustrate a molding procedure of the pump. FIG. 5 shows a first step where the cylinder 1 is formed out of a resin material. Then as shown in FIG. 6 the piston 2 is formed out of an insoluble resin material with the cylinder 1. In the figure, 2*c* stands for a hole for the forming anchor boss 3*b* of a valve 3. Finally the valve 3 is formed out of an insoluble resin material with the piston 2 and thus a finished product is obtained as shown in FIG. 1. Since molding shrinkage rate of the forming material of the valve 3 is lower than molding shrinkage rate of the forming material of the piston 2, the hole 2*c* of the piston 2 shrinks more than the anchor boss 3*b* of the valve 3 thus an anchor effect to prevent slipping out of the valve is attained.

By employing the forming material of the piston 2 with lower molding shrinkage rate than molding shrinkage rate of the material of the cylinder 1, a sealing effect of the piston pump is obtained due to an appropriate molding contraction of the cylinder.

In this embodiment the cap 5 is formed separately, but it can be formed by a series of multi-color molding in the same way as the other parts are formed. A finished pump shown in FIG. 2 is obtained by forming the cap 5 additionally to the piston pump in FIG. 1.

Embodiment 2

Figure 7:
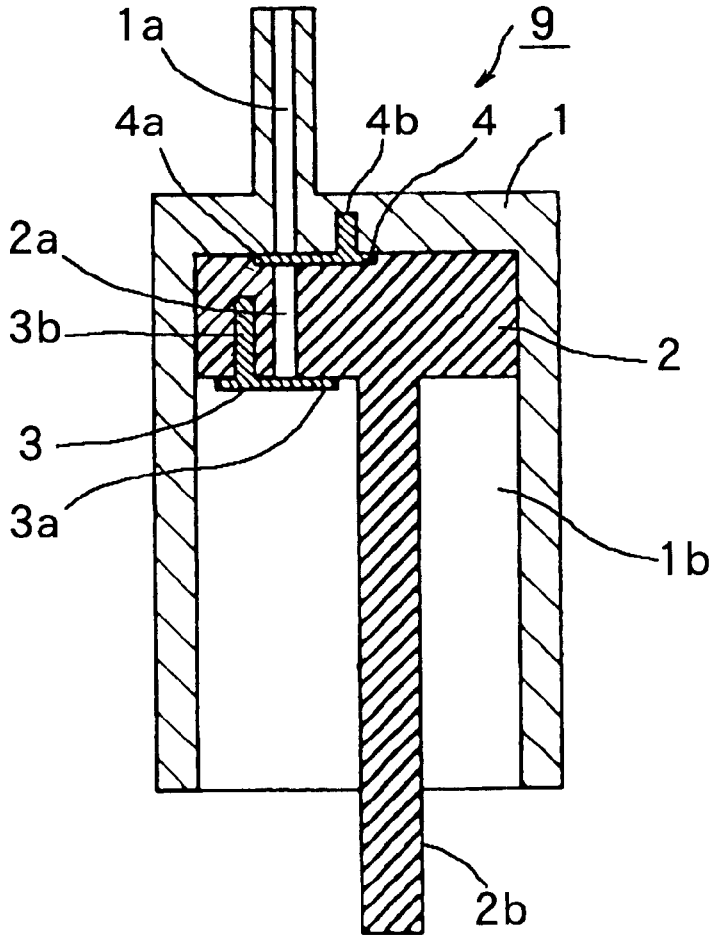
FIG. 7 is a sectional view of a pump in a second embodiment.

FIG. 7 is a sectional view of a piston pump 9 in the embodiment 2, where a second check valve 4 is constituted in the cylinder 1 of the above-described embodiment 1 to prevent a reversed flow of ink from the cylinder space 1*c* at the sucking side to the recording head 6. The second check valve 4 is formed out of a combination of an insoluble resin material with that of the cylinder 1 by the insert molding or the multi-color molding as shown in FIG. 7.

Hereinafter a sucking movement of the recording head is explained by referring to FIGS. 8, to 10.

In these figures a numeric character 6 stands for a recording head, 5 stands for a cap tightly attached to the recording head to form a closed system and usually formed out of an elastic material such as a rubber, an elastomer etc. The pump unit 10 in the second embodiment is fixed to the cap 5.

Figure 8:
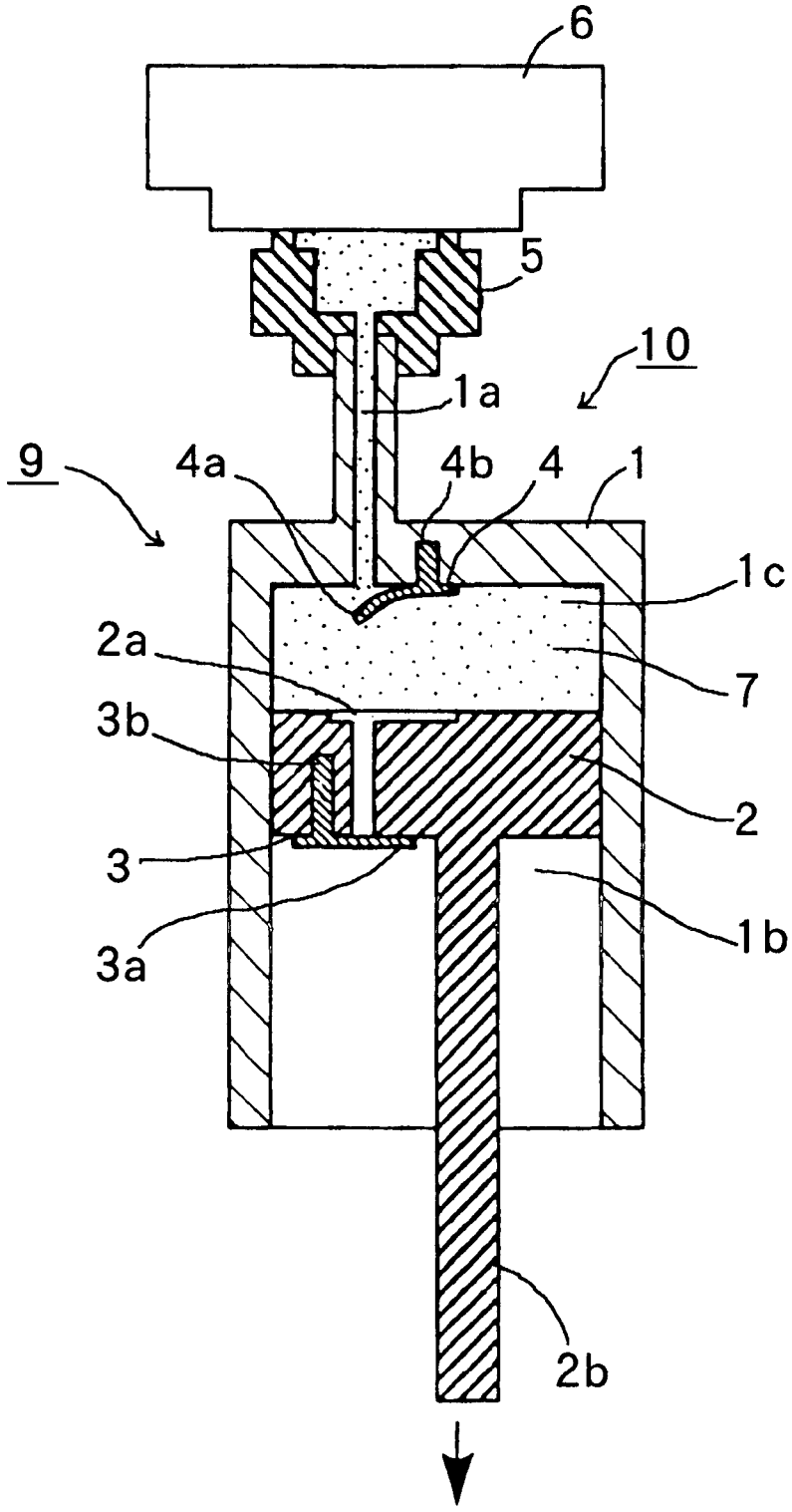
FIG. 8 is a sectional view of the pump in the second embodiment attached to an ink-jet recording head for ink suction.

FIG. 8 illustrates a sucking status where the piston 2 is connected with the unshown deriving means via rod portion 2*b* of the piston and is pulled in a direction of the arrow in the figure. Since a pressure at the cylinder space 1*c* at sucking side becomes negative, a valve plate 4*a* of the second check valve 4 is opened so that ink 7 enters the cylinder space 1*c* at the sucking side via suction channel 1*a*. In this stage, the valve plate 3*a* of the first check valve 3 is closed due to the negative pressure of the cylinder space 1*c* at the sucking side.

Figure 9:
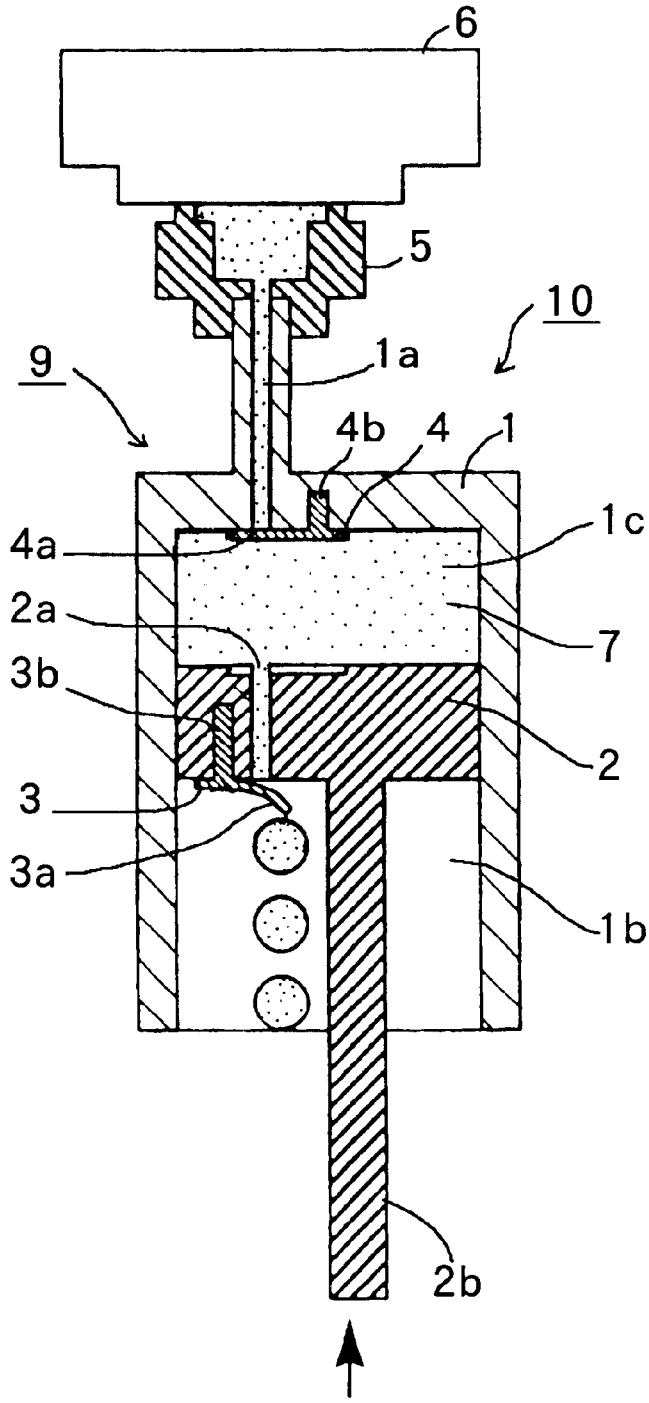
FIG. 9 is a sectional view of the pump in FIG. 8 illustrating an ink ejection procedure.

FIG. 9 illustrates an ejecting movement of the ink from the cylinder space 1*c* at the sucking side to the cylinder space 1*b* at the ejecting side, where the piston 2 is pushed by the unshown driving means via the rod portion 2*b* of the piston in a direction of the arrow shown in the figure. Since a pressure in the cylinder space 1*c* at the sucking side becomes positive due to the movement of the rod, the valve plate 3*a* of the check valve 3 is bent so that the cylinder space 1*c* at the sucking side and the cylinder space 1*b* at the ejecting side are connected via the ink channel 2*a,* and ink flows from the cylinder space 1*c* to the cylinder space 1*b* as depicted in the figure. At this stage, since the valve plate 4 of the second check valve 4 is closed due to the positive pressure of the cylinder space 1*c* at the sucking side, ink 7 in the cylinder space 1*c* does not flow reversely to the recording head 6.

By repeating a series of these sucking and ejecting movements, foreign particles and bubbles or stuck ink and thickened ink etc. which will cause poor recording performance, are removed from the recording head 6.

Figure 10:
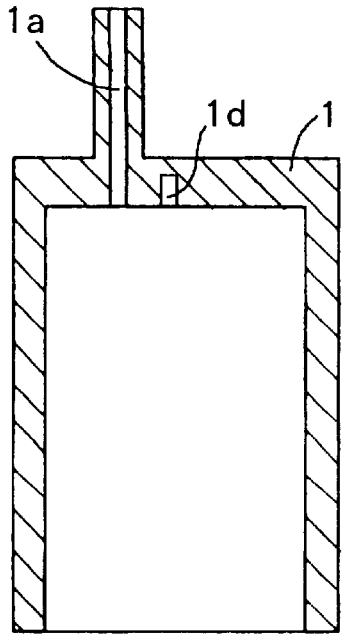
FIG. 10 is a sectional view of a first forming step of the pump in the second embodiment.
Figure 11:
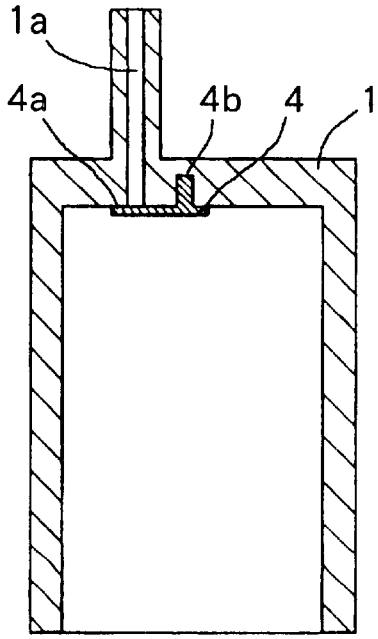
FIG. 11 is a sectional view of a second forming step of the pump in FIG. 10.
Figure 12:
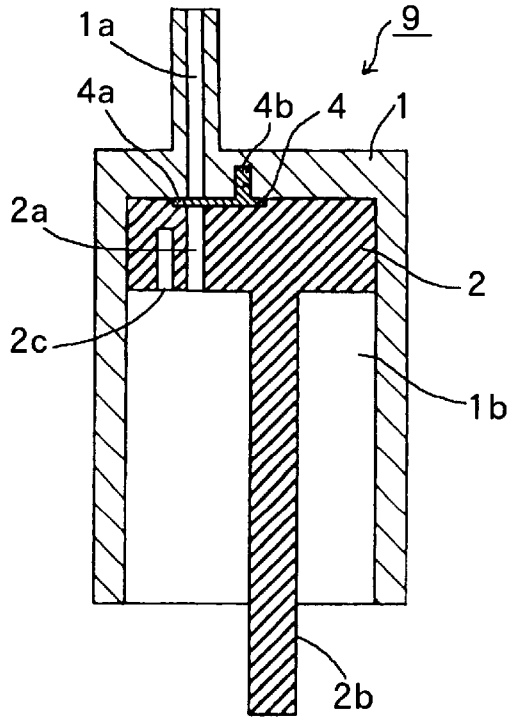
FIG. 12 is a sectional view of a third forming step of the pump in FIG. 11.

FIGS. 10 to 12 illustrate a molding procedure of the pump. FIG. 10 shows a first stage of the molding procedure where the cylinder 1 is formed out of a transparent resin material. At a second stage as shown FIG. 11, the second check valve 4 is formed out of an insoluble resin material with that of the cylinder 1. Since the material of the second check valve 4 is selected so that its molding shrinkage rate is lower than molding shrinkage rate of the material of the cylinder 1, a hole 1*d* of the cylinder 1 shrinks more than the anchor boss 4*b* of the second check valve 4 does, which attains an anchor effect to prevent the second check valve 4 from slipping out of the cylinder.

Then as shown FIG. 12, as a third step the piston 3 is formed out of an insoluble resin material with that of the cylinder 1. Finally, the first check valve 3 is formed out of an insoluble resin material with that of the piston 2 thus the molding procedure is completed as shown in FIG. 7.

In the same way as the above described embodiment, since the forming material of the first check valve 3 is selected so that its molding shrinkage rate is lower than that of the forming material of the piston 2, a hole 2*c* of the piston 2 shrinks more than the an anchor boss 3*b* of the check valve 3 does, so that an anchor effect to prevent the first check valve from slipping out of the piston.

In this embodiment 2 the cap 5 is formed separately, but it can be formed by a series of multi-color molding in the same way as the other parts are formed. In this case a finished pump shown in FIG. 8 is obtained by forming the cap 5 additionally to the piston pump shown in FIG. 7.

Embodiment 3

Figure 13:
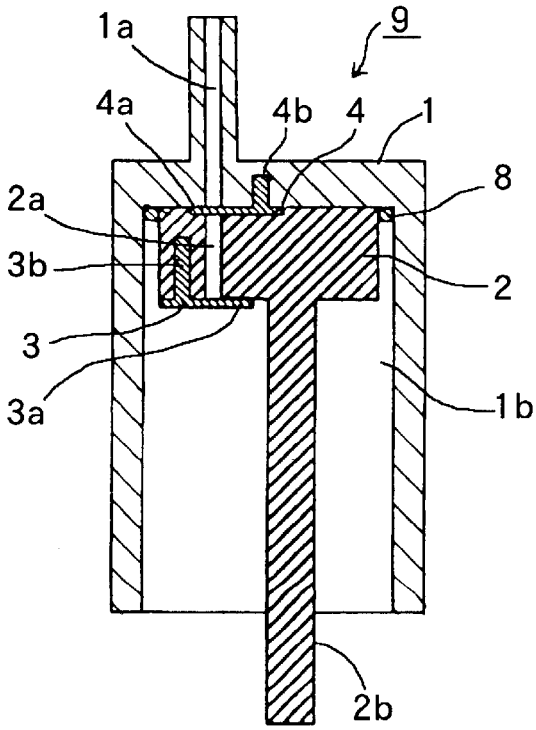
FIG. 13 is a sectional view of a pump in a third embodiment.

FIG. 13 illustrates a sectional view of a third embodiment according to the present invention where an elastic member 8 for sealing is added to the piston pump 9 in the above-described embodiment 2. In the same way as the above describe embodiment 1, a combination of resin materials of the cylinder 1 and the piston 2 is selected so as to be insoluble each other. The elastic member 8 is formed out of a rubber or an elastomer having compatibility with the piston 2 and incompatibility with the cylinder 1.

Figure 14:
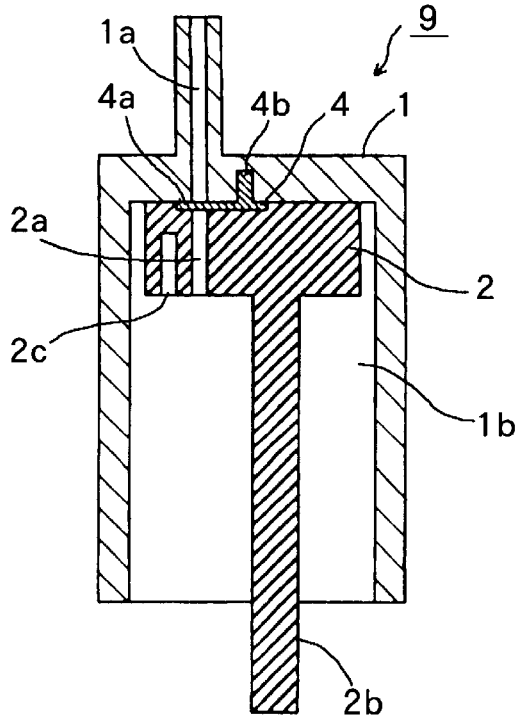
FIG. 14 is a sectional view of a first forming step of the pump in FIG. 13.
Figure 15:
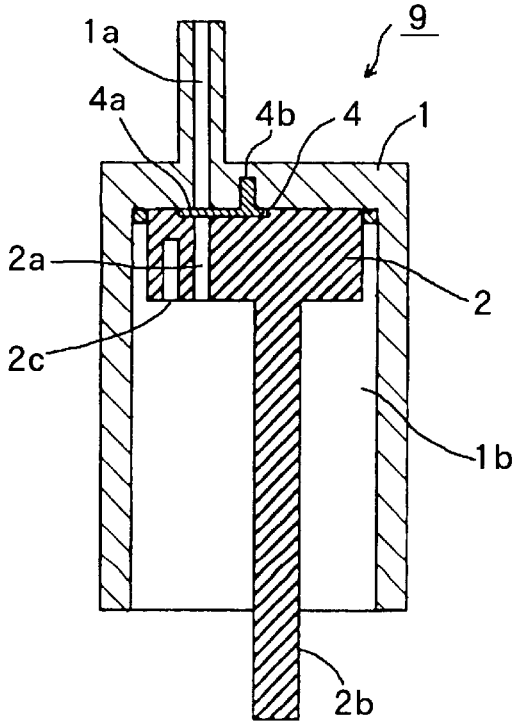
FIG. 15 is a sectional view of a second forming step of the pump in FIG. 14.

A molding procedure of this embodiment is described by referring to FIG. 14 and FIG. 15. Up to the forming steps of the cylinder 1 and the second check valve 4, the forming procedure is the same as the second embodiment.

Then as shown in FIG. 14 the piston 2 is formed out of a resin material soluble with the elastic member 8, but insoluble with the cylinder 1.

The elastic member 8 is formed out of a resin material soluble with the piston 2, but insoluble with the cylinder 1, as shown in FIG. 15.

Finally the first check valve 3 is formed so as to obtain the finished product as shown in FIG. 13. Due to compatibility among the forming materials, only the elastic member 8 and the piston 2 are bonded. Therefore, the piston 2 can be moved freely in the direction of the axis of the finished piston pump.

And by employing the forming material of the elastic member 8 or the piston 2 with lower molding shrinkage rate than molding shrinkage rate of the cylinder 1, a sealing effect of the piston pump is attained due to an appropriate molding contraction of the cylinder.

In this embodiment 3 the cap 5 is formed separately, but it can be formed by a series of multi-color molding in the same way as the other parts are formed. In this case the cap 5 is formed additionally to the piston pump shown in FIG. 13.

As described above, according to the present invention a pump unit capable of being employed in an ink-jet recording head and so forth, can advantageously be provided at a low cost with high reliability, by forming the cylinder, the piston and valve with mutually insoluble resin materials each other by insert molding or multi-color molding so as to eliminate assembling procedure and supervising man-hours during manufacturing.

Hereinafter other embodiments relating to a rotary valve unit and a sliding valve unit which are used as peripheral parts of an ink-jet recording head are described.

Embodiment 4

Figure 16:
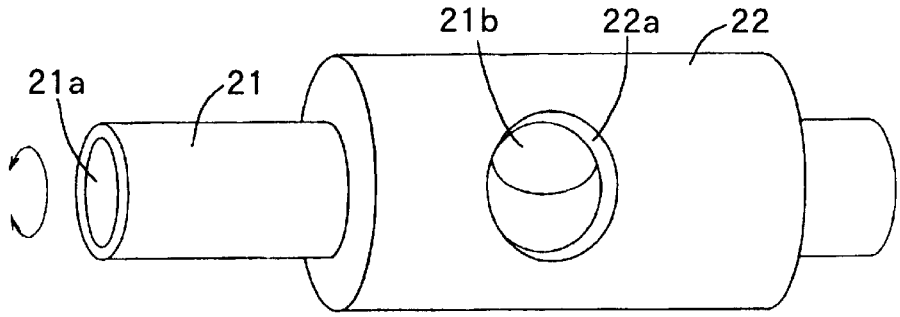
FIG. 16 is a perspective view of a rotary valve unit in a fourth embodiment.

FIG. 16 is a perspective view of a rotary valve unit in the embodiment 4. The rotary valve unit is consisted of a first cylindrical body 21 for an inner cylinder and a second cylindrical body 22 for an outer cylinder where the inner cylinder is inserted into the outer cylinder so as to be capable of rotating relatively to the outer cylinder.

The inner cylinder 21 has a hollow structure in its cross-section, a flow path 21*a* where liquid flows through.

In the inner cylinder 21 the above-mentioned flow path 21*a* and an opening 21*b* on the cylindrical surface of it are formed and an opening 22*a* is at a hollow portion of the cylinder 22.

In the above-mentioned constitution, liquid flows via a unshown tube etc. to the above-mentioned flow path 21*a* and flows out of the opening 21*b*.

When the inner cylinder 21 and the outer cylinder 22 are positioned as shown in FIG. 16 where a flow path formed so that the liquid flows out from the opening 22*a* on the outer cylinder 22.

When the flow path is required to be closed the inner cylinder is rotated relatively to the outer cylinder so that the openings 21*b* and 22*a* do not face each other. At this position the opening 21*b* is covered with the inner wall of the outer cylinder 22 so that the liquid can not flow out.

Due to a difference between melting points etc. mutually insoluble resins are employed as materials for two cylinders 21 and 22 of the valve unit. Poly-butylene vs. styrene elastomer can be employed as an example of the mutually insoluble resin combinations. A two color injection molding can be carried out by employing such combination.

When a requirement of a sealing effect of the valve unit is so significant, relation of the shrinkage rate of two resin materials is set as follows;

inner cylinder (21)>outer cylinder (22).

As a result an appropriate clearance (gap) between the inner cylinder 21 and the outer cylinder 22 is formed so as to ensure a rotation and a gas-tightness of the unit. When the requirement of the sealing effect is significant, the relation of the shrinkage rate is set as follows;

inner cylinder (21)≦outer cylinder (22).

In this case, an appropriate close contact between the inner cylinder 21 and the outer cylinder is attained so as to ensure the good sealing effect.

In this way since the rotary valve unit capable of being opened/shut freely by the rotation can be manufactured by one step procedure such as the insert molding or the two color molding, a procedure to assemble the valve unit is not necessary as the conventional one was. The valve manufactured in the above-mentioned way, can be applicable any fluid, either gas or liquid.

Embodiment 5

Figure 17:
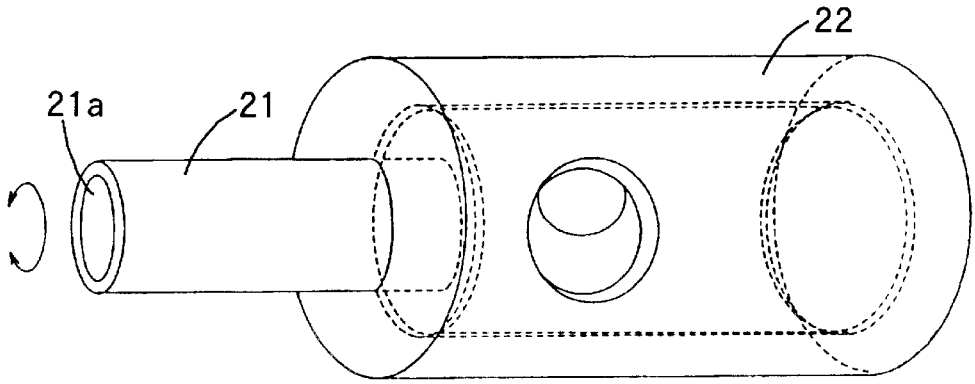
FIG. 17 is a perspective view of a rotary valve unit with a stopper to prevent slipping out of parts in a fifth embodiment.

FIG. 17 is a perspective view of a valve unit in the embodiment 5 according to the present invention where an inner cylinder 21 and an outer cylinder 22 are connected in the same way as the embodiment 4.

The inner cylinder 21 is capable of being rotated by a guide of the outer cylinder 21.

In addition in the embodiment 5 the valve unit has a structure where the outer cylinder 22 covers a portion with larger diameter of the inner cylinder 21 completely.

Which prevents the inner cylinder from slipping out of the outer cylinder 22.

Since the rotary valve unit with the anti-slipping-out structure capable of being opened/shut freely by the rotation can be manufactured by one step procedure such as the insert molding or the two color molding, where a step to assemble the valve unit is not necessary as the conventional one was.

Embodiment 6

Figure 18:
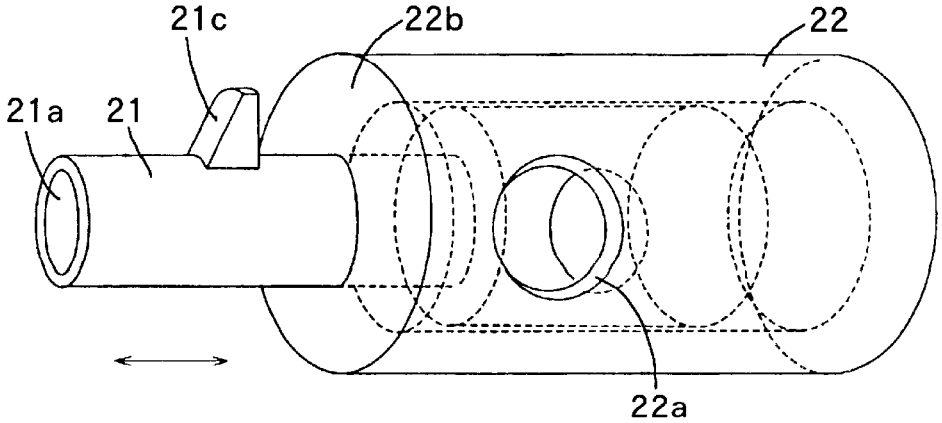
FIG. 18 is a perspective view of a slide valve unit with a stopper to prevent slipping out of parts in a sixth embodiment.

FIG. 18 is a perspective view of a slide valve unit with anti-slipping out protrusion in the embodiment 6 according to the present invention where an inner cylinder 21 is tightly connected with an outer cylinder 22.

The inner cylinder 21 can slide by a guide of the outer cylinder 22 along a direction of its axis. In addition in the embodiment 6 a portion 22*b* to prevent slipping-out of the inner cylinder 21 is formed on the outer cylinder 22 so that the cylinder 21 collides with the portion 22*b* when it moves toward the left direction in the figure.

Moreover, a protrusion 21*c* to prevent the inner cylinder 21 from slipping out of the outer cylinder 22 is formed so that the protrusion 21*c* collides with the portion 22*b* of the outer cylinder 22 when the inner cylinder moves toward the right direction in the figure.

Since the slide valve unit having the above-mentioned anti-slipping-out structures with flexible open/shut movements can be manufactured by one step procedure such as the insert molding or two color molding, where a step to assemble the valve unit is not necessary as the conventional one was.

Although the inner cylinder 21 and outer cylinder 22 show columnar sections as shown in FIG. 18, the shape of the section is not limited to this example but any shape, for example, a rectangular section is employable as far as a parallel sliding movement is ensured.

In the conventional valve unit having structures mentioned above, it has been rather difficult to form a structure to prevent the slipping-out with enough strength. Because if such structure to prevent slipping-out was formed, it would become an obstacle to assemble the valve unit or enough anti-slipping-out strength could no be attained.

As measures against the above-mentioned drawbacks, additional stop member was formed and built in after inserting the inner cylinder 21 into the outer cylinder 22.

According to the embodiment 6 a slide valve unit manufactured with much reduced number of parts and assembling steps can be provided.

Embodiment 7

Figure 19:
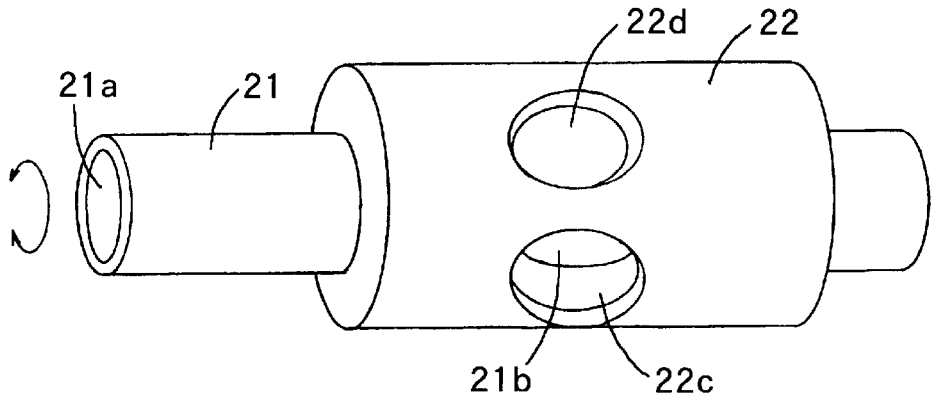
FIG. 19 is a perspective view of a rotary valve unit for altering flow path in a seventh embodiment.

FIG. 19 is a perspective view of a rotary valve unit in the embodiment 7.

The inner cylinder 21 is tightly connected with the outer cylinder 22 and is capable of sliding circularly by a guide of the outer cylinder 22.

An opening 21*b* is formed on the inner cylinder 21 while two openings 22*c* and 22*d* are formed on the outer cylinder 22. Liquid flows through the flow path 21*a* and flows out from the opening 22*c*, since the position of the opening 21*b* is aligned to face the opening 22*c*.

When the opening 21*b* is aligned to face the opening 22*d* by rotating the inner cylinder 21, the liquid flows out from the opening 22*d*.

In this way the rotary valve capable of selectively altering the flow path can be constituted.

The rotary valve unit capable of altering the flow path freely by the sliding movement can be manufactured by one step procedure such as by the insert molding or by two color molding at an inexpensive cost in the same way as the embodiment 4.

Embodiment 8

Figure 20:
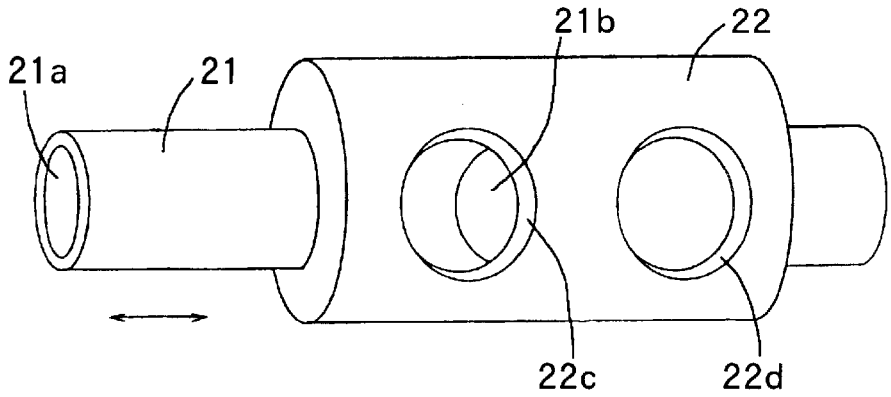
FIG. 20 is a perspective view of a slide valve unit for altering flow path in a eighth embodiment.

FIG. 20 is a perspective view of a sliding valve unit in the embodiment 8 according to the present invention.

In the embodiment 8, since the same features as the rotary valve unit as shown in FIG. 19 having two openings 22*c* and 22*d* on the outer cylinder 22 are obtained so as to function in the same way as the embodiment 7 except a difference between rotation and sliding, further explanations are omitted.

Embodiment 9

In the embodiment 9 at least one of the inner cylinder 21 and the outer cylinder 22 in the above described embodiments 4 to 8 is formed out of an elastic material.

When the elastic materiel is employed it is preferable that the relation between molding shrinkage rate of the inner cylinder 21 and the outer cylinder 22 is reversed.

Figure 21:
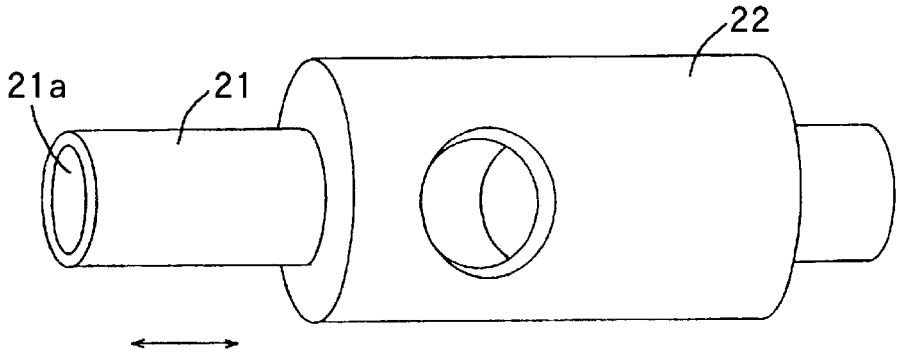
FIG. 21 is a perspective view of a slide valve unit where one of the parts is made of an elastic material in a ninth embodiment.
Figure 22:
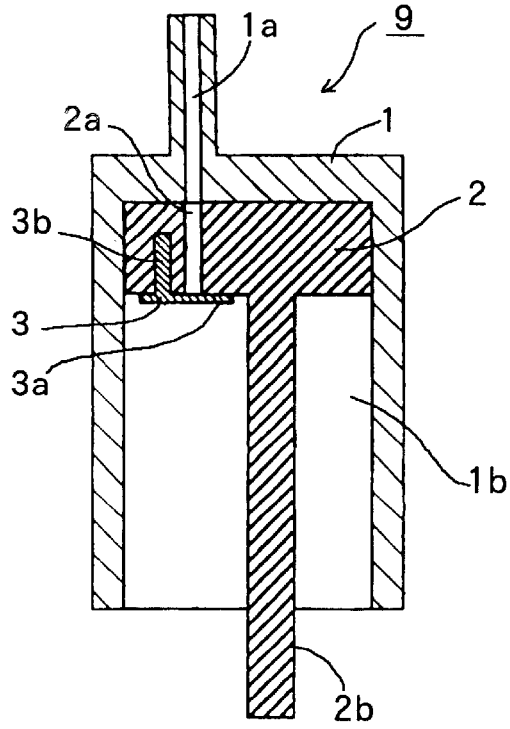
FIG.22 (PRIOR ART)
FIG. 22 is a sectional view of an example of conventional piston pumps.
Figure 23:
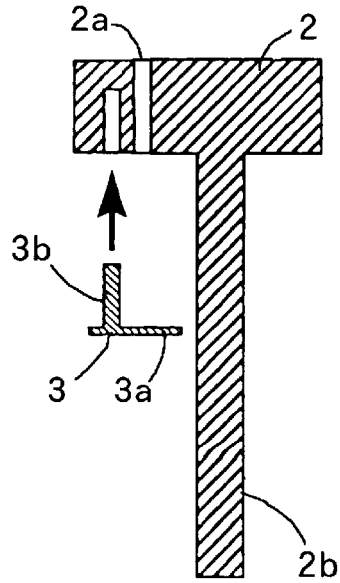
FIG.23 (PRIOR ART)
FIG. 23 is a sectional view of the piston of the pump in FIG. 22.

Namely in a case of a sliding valve unit shown in FIG. 21 a molding condition is set as follows;

molding shrinkage rate of the inner cylinder<molding shrinkage rate of the outer cylinder.

As materials for this purpose, for example, a rubber and an elastomer etc. are employable.

A gas-tightness is enhanced due to an elastic deformation of the material, but a load due to friction during the rotation/sliding movements does not increase too much.

By utilizing the features mentioned above, a valve unit with high gas-tightness at inexpensive cost can be manufactured.

It is obvious that a valve unit with multi-functions can be manufactured by combining above-mentioned embodiments.

As explained above, low cost peripheral units for ink-jet recording heads can be provided by the insert molding or the multi-color molding where mutually insoluble resin materials each other for each part of the unit are employed so that assembling procedure can be eliminated.

In addition a firm and enhanced connection between two parts such as an anchor effect can be attained by a combination of materials with different molding shrinkage rate. Gas-tight units can be obtained by selecting an elastic materiel for one of the parts in the unit without losing mutual smooth movements of the parts.

Namely, peripheral parts around the ink reservoir of the ink-jet recording head with higher quality and at less expensive cost than the conventional method can be provided according to the present invention.

Figure 24:
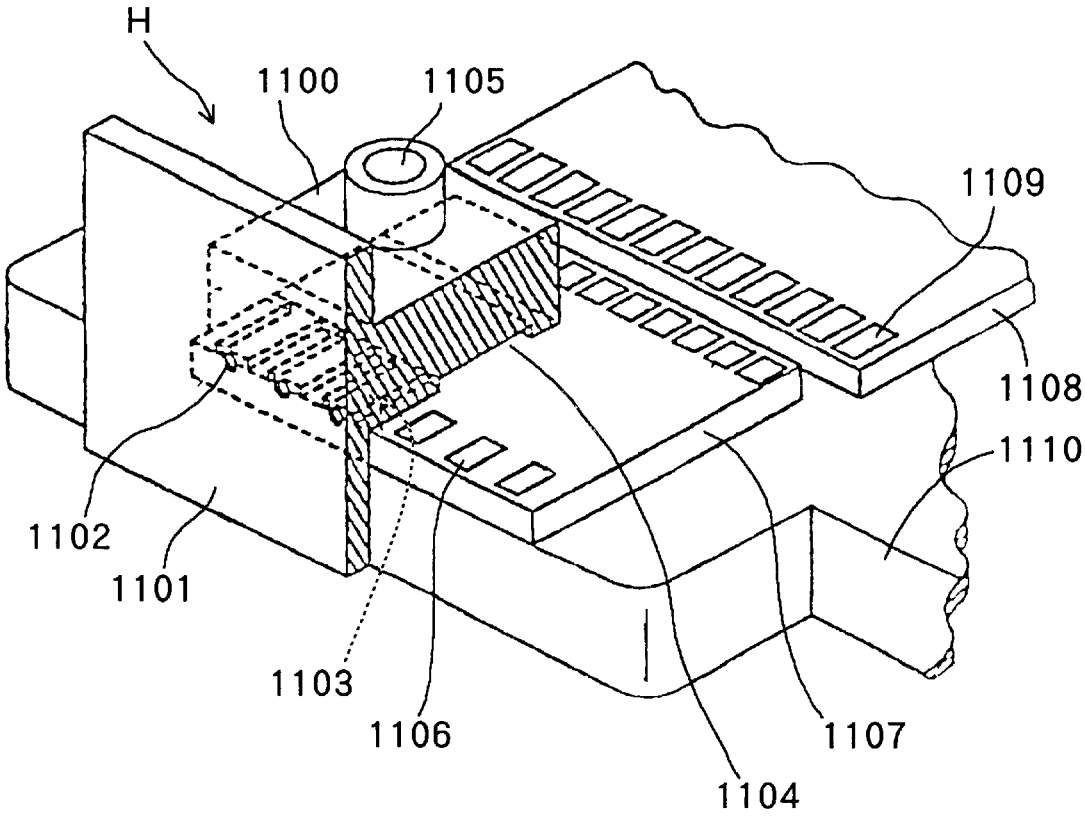
FIG. 24 is a partially cutout schematic perspective view illustrating a main potion of an ink-jet recording head to be equipped in a head cartridge where embodiments of the present invention are applied.

Hereinafter a general constitution of the above-mentioned inkjet recording head is explained by referring to FIG. 24.

A top plate 1100 constituting an ink-jet recording head H formed out of a resin material is molded into one piece comprised of a liquid reservoir 1104 to store recording liquid, a top plate member to form a plurality of liquid paths 1103, an eject port forming plate 1101 where a plurality of eject ports (orifices) 1102 respectively are connected with the liquid paths 1104 so that liquid flow from the liquid paths to the eject ports and an opening 1105 to supply the recording liquid. A heater board (element board) 1107 made of a silicon base plate where a plurality of heaters (electro-thermo conversion modules) 1106 aligned and aluminum wiring etc. (not shown) are formed by a conventional thin film forming technology, is fixed to a base plate 1110 by a conventional die-bonding technology after determining its position. On a wiring board 1108 leading wires connected with the corresponding wires on the heater board 1107 by a conventional wire bonding technology and a plurality of pads 1109 connected with the end of lead wires, which receive electric signals from a recording apparatus, are formed. The top plate 1100 and the heater board 1107 are fixed together so as to face corresponding positions to liquid paths 1103 and heaters 1106 and fixed on the base plate 1110 together with the wiring board, thus the ink-jet recording head H is constituted.

Figure 25:
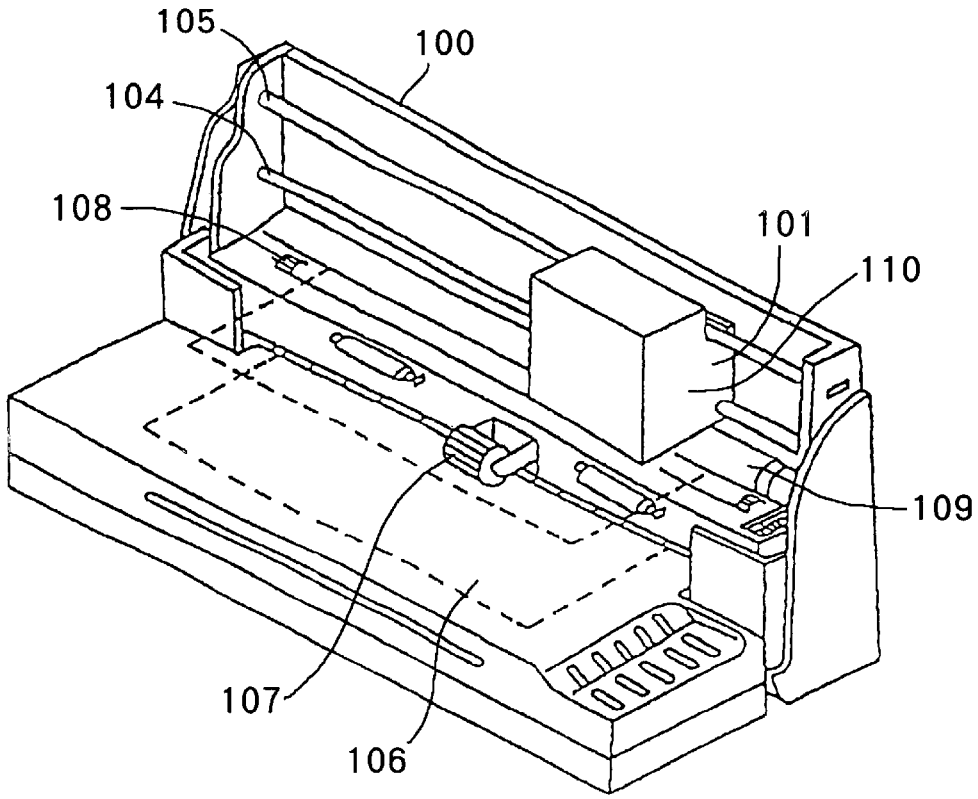
FIG. 25 is a perspective view of an ink-jet recording apparatus mounting a head cartridge where embodiments of the present invention are applied.

FIG. 25 is a perspective view of an ink-jet recording apparatus where a head cartridge 110 is mounted. A leading screw 104 and a guiding shaft 105 positioned parallel each other are equipped on a casing of the ink-jet recording apparatus in FIG. 25. A carriage 101 is attached to the leading screw 104 and the guiding shaft 105 so as to move in a direction parallel to the leading screw 104 and the guiding shaft 105. The carriage 101 is moved parallel by rotating the leading screw 104 with a carriage motor (not shown).

On the carriage 101 the head cartridge 110 equipped with the ink-jet recording head H is mounted. A paper pressing plate 109 is equipped at a position to face an eject port surface of the ink-jet head H.

On the ink-jet recording apparatus, a paper supply roller 107 which sends recording paper 106 toward the recording area of the recording head H and a paper ejecting roller 108 which ejects recorded recording paper 106 by the ink-jet head H, are also equipped. The paper supply roller 107 and the paper ejecting roller 108 are rotated by a unshown motor. A recorded medium sending unit which sends the recording paper 106, where ejected liquid from ink-jet recording head H is received, is comprised of the above-mentioned motor, the paper supply roller 107 and the paper ejecting roller 108 etc. The carriage 101 moves to and fro so as to cross a sending direction of the recording paper 106 the recorded medium sending unit is operated.

A recorded image is formed on the surface of the recording paper 106 by sticking ink ejected from the ink-jet recording head H on the recording paper faced the surface of eject ports. The recording paper 106 is ejected out of the ink-jet recording apparatus by a synchronized movement of the paper supply roller 107 and the paper ejecting roller 108 rotated by the motor, and with the aide of the paper pressing plate 109 in accordance with a progress of the recording operation on the recording paper 106.

What is claimed is:

1. A piston pump comprised of a cylinder, a piston and a valve formed out of materials mutually insoluble in each other by an insert molding or a multi-color molding.

2. A piston pump according to claim 1, wherein a molding shrinkage rate of a material for forming said piston is lower than a molding shrinkage rate of a material for forming said cylinder.

3. A piston pump according to claim 1, wherein a material for forming said valve is a rubber or an elastomer.

4. A piston pump according to claim 1, wherein a molding shrinkage rate of a material for forming said valve is lower than a molding shrinkage rate of a material for forming said piston.

5. A piston pump according to claim 1, wherein a portion of said piston which slides against said cylinder is formed out of an elastic material soluble in a material for forming said piston and insoluble in a material for forming said cylinder by an insert molding or a multi-color molding.

6. A piston pump according to claim 5, wherein said elastic material is a rubber or an elastomer.

7. A piston pump according to claim 5, wherein a molding shrinkage rate of said elastic material or said material for forming said piston is lower than a molding shrinkage rate of said material for forming said cylinder.

8. A piston pump according to claim 1, wherein a first valve is formed at an ejection port of said piston and a second valve is formed at an inlet port of said cylinder.

9. A piston pump according to claim 8, wherein each of materials of said first and said second valves is a rubber or an elastormer.

10. A piston pump according to claim 9, wherein a molding shrinkage rate of said material of said second valve is lower than a molding shrinkage rate of a material for forming said cylinder.

11. A pump unit for an ink-jet recording apparatus comprised of said piston pump according to claim 1 and a cap attached closely to an ink-jet recording head to suck ink formed by an insert molding or a multi-color molding.

12. A pump unit for an ink-jet recording apparatus according to claim 11, wherein a material for forming said cap is a rubber or an elastomer.

13. An ink-jet recording apparatus equipped with a pump unit according to claim 11.

14. An ink-jet recording apparatus according to claim 13, wherein ink is ejected by utilizing thermal energy.

15. A valve comprised of a first part having a cylindrical hole bearing at least one opening for a flow path and a second part engaged in said cylindrical hole of said first part capable of rotating freely so as to connect with said at least one opening for said flow path of said first part, and said first and second parts are formed out of materials mutually insoluble in each other by an insert molding or a two-color molding.

16. A valve according to claim 15, wherein said first part or said second part has a fastener to prevent it from slipping out of said other part.

17. A valve according to claim 15, wherein a material of said first part or said second part is an elastic material.

18. A valve according to claim 17, wherein said elastic material is a rubber or an elastomer.

19. A valve comprised of a first part having a cylindrical hole bearing at least two openings for flow paths and a second part engaged in said cylindrical hole of said first part capable of rotating freely so as to select at least one of said openings for said flow paths of said first part selectively and said first and second parts are formed out of materials mutually insoluble in each other by an insert molding or a two-color molding.

20. A valve according to claim 19, wherein said first part or said second part has a fastener along its axis to prevent it from slipping out of said other part.

21. A valve according to claim 19, wherein a material of one of said first part and said second part is an elastic material.

22. A valve according to claim 21, wherein said elastic material is a rubber or an elastomer.

23. A valve comprised of a first part having a cylindrical hole bearing at least one opening for a flow path and a second part engaged in said cylindrical hole of said first part capable of sliding freely so as to connect with said at least one opening for said flow path of said first part and said first and second parts are formed out of materials mutually insoluble in each other by an insert molding or a two-color molding.

24. A valve according to claim 23, wherein said first part or said second part has a fastener along its axis to prevent it from slipping out of said other part.

25. A valve according to claim 23, wherein said first part or said second part is formed out of an elastic material.

26. A valve according to claim 25, wherein said elastic material is a rubber or an elastomer.

27. A valve comprised of a first part having a cylindrical hole bearing at least two openings for flow paths and a second part engaged in said cylindrical hole of said first part capable of sliding freely so as to select at least one of said openings for said flow paths of said first part selectively and said first and second parts are formed of materials mutually insoluble in each other by an insert molding or a two-color molding.

28. A valve according to claim 27, wherein said first part or said second part has a fastener along its axis to prevent disintegration of said part.

29. A valve according to claim 27, wherein a material of said first part or said second part is an elastic material.

30. A valve according to claim 29, wherein said elastic material is a rubber or an elastomer.

31. Parts for an ink-jet recording apparatus, wherein said parts come into contact with ink and with other parts, and said parts are formed out of materials mutually insoluble in each other by an insert molding or multi-color molding.

32. Parts for an ink-jet recording apparatus according to claim 31, wherein said multi-color molding is a two-color molding.

33. Parts for an ink-jet recording apparatus according to claim 31, wherein said parts include a pump unit.

34. Parts for an ink-jet recording apparatus according to claim 33, wherein said parts include a piston and a cylinder.

35. Parts for an ink-jet recording apparatus according to claim 33, wherein said parts include a piston and a valve formed in said piston.

36. Parts for an ink-jet recording apparatus according to claim 33, wherein said parts include a cylinder and a valve formed in said cylinder.

37. Parts for an ink-jet recording apparatus according to claim 31, wherein said parts include a portion of a pump connected with a cylinder and a cap connected with said portion so as to cover an ink ejection port for ejecting ink.

38. Parts for an ink-jet recording apparatus according to claim 31, wherein said parts include a valve.

39. Parts for an ink-jet recording apparatus according to claim 34, wherein said parts include a valve formed in said piston.

40. Parts for an ink-jet recording apparatus according to claim 34, wherein said parts include a valve formed in said cylinder.

* * * * *

UNITED STATES PATENT AND TRADEMARK OFFICE

CERTIFICATE OF CORRECTION

PATENT NO. : 6,551,079 B1
DATED : April 22, 2003
INVENTOR(S) : Masakatsu Iwata et al.

It is certified that error appears in the above-identified patent and that said Letters Patent is hereby corrected as shown below:

Title page,
Item [57], ABSTRACT,
Line 3, “unit” should read -- units --.

Column 1,
Lines 7 and 10, “relates” should read -- relates to --;
Line 12, “Arts” should read -- Art --;
Line 22, “for” should read -- for an --;
Line 26, “a time” shoud read -- time --;
Line 31, “a case” should read -- care --; and
Line 43, “as a result” should read -- result in --.

Column 2,
Line 7, “each” should be deleted;
Line 8, “other” should be deleted;
Line 41, “each other” should be deleted; and
Line 47, “manhours” should read -- man-hours --.

Column 3,
Line 30, “a eighth” should read -- an eighth --;
Line 40, “potion” should read -- portion --; and
Line 58, “each” should read -- to each --.

Column 4,
Line 8, “keeping contacts” should read -- keep in contact --;
Line 9, “each other,” should be deleted;
Line 10, “each other” should be deleted;
Line 26, “a unshown” should read -- an unshown --; and
Line 61, “3 thus” should read -- 3. Thus --.

Column 5,
Line 44, “valve plate 4” should read -- valve plate 4a --.

UNITED STATES PATENT AND TRADEMARK OFFICE

CERTIFICATE OF CORRECTION

PATENT NO. : 6,551,079 B1
DATED : April 22, 2003
INVENTOR(S) : Masakatsu Iwata et al.

It is certified that error appears in the above-identified patent and that said Letters Patent is hereby corrected as shown below:

Column 6,
Line 2, “2 thus” should read -- 2. Thus --;
Line 7, “the an” should read -- an --;
Line 8, “so that” should read -- resulting in --;
Line 21, “describe” should read -- described --;
Line 23, “each” should read -- to each --; and
Line 57, “each other” should be deleted.

Column 7,
Line 10, “cylinder” should read -- outer cylinder --;
Line 11, “via a” should read -- via an --;
Line 15, “where” should be deleted and “formed” should read -- is formed --;
Line 22, “can not” should read -- cannot --;
Line 43, “cylinder” (2nd occurrence) should read -- cylinder 22 --; and
Line 50, “applicable” should read -- applicable to --.

Column 8,
Line 7, “anti-slipping out” should read -- anti-slipping-out --;
Line 14, “cylinder” should read -- inner cylider --;
Line 19, “cylinder” (2nd occurrence) should read -- cylinder 21 --;
Line 24, “where” should be deleted; and
Line 38, “no” should read -- not --.

Column 9,
Line 7, “except” should read -- except for --;
Line 39, “each other” should be deleted;
Line 45, “materiel” should read -- material --;
Line 52, “inkjet” should read -- ink-jet --; and
Line 59, “flow” should read -- flows --.

UNITED STATES PATENT AND TRADEMARK OFFICE

CERTIFICATE OF CORRECTION

PATENT NO. : 6,551,079 B1
DATED : April 22, 2003
INVENTOR(S) : Masakatsu Iwata et al.

It is certified that error appears in the above-identified patent and that said Letters Patent is hereby corrected as shown below:

Column 10,
Line 7, “board,” should read -- board; --;
Line 11, “parallel” should read -- parallel to --;
Line 28, “a unshown” should be -- an unshown --;
Line 34, “l06 the” should read -- 106 when the --;
Line 38, “faced” should read -- facing --; and
Line 42, “aide” should read -- aid --.

Column 11,
Line 8, “elastormer.” should read -- elastomer. --.

Signed and Sealed this

Eighteenth Day of November, 2003

JAMES E. ROGAN
*Director of the United States Patent and Trademark Office*